US007168189B2

(12) United States Patent
Phelan

(10) Patent No.: US 7,168,189 B2
(45) Date of Patent: Jan. 30, 2007

(54) INTERCHANGEABLE FOOTWEAR SYSTEM

(76) Inventor: Ann C. Phelan, 144 E. 24th St., Apt. #5-D, New York, NY (US) 10010

( * ) Notice: Subject to any disclaimer, the term of this patent is extended or adjusted under 35 U.S.C. 154(b) by 6 days.

(21) Appl. No.: 10/946,811

(22) Filed: Sep. 22, 2004

(65) Prior Publication Data

US 2006/0059720 A1 Mar. 23, 2006

(51) Int. Cl.
*A43B 3/24* (2006.01)

(52) U.S. Cl. ..... 36/101; 36/11.5

(58) Field of Classification Search ..... 36/101, 36/11.5

See application file for complete search history.

(56) References Cited

U.S. PATENT DOCUMENTS

| | | | | | |
|---|---|---|---|---|---|
| 2,368,314 | A | * | 1/1945 | Marx | 36/11.5 |
| 2,438,711 | A | * | 3/1948 | Leach et al. | 36/101 |
| 2,761,224 | A | * | 9/1956 | Gardiner | 36/11.5 |
| 2,976,623 | A | | 3/1961 | Gallaway | |
| 3,012,341 | A | | 12/1961 | Schaefer | |
| 3,570,147 | A | | 3/1971 | Chiu | |
| 3,841,003 | A | * | 10/1974 | Huyge | 36/11.5 |
| 3,925,915 | A | | 12/1975 | Colli | |
| 3,983,642 | A | * | 10/1976 | Liao | 36/101 |
| 4,193,214 | A | | 3/1980 | Wang | |
| 4,439,935 | A | | 4/1984 | Kelly | |
| 4,450,633 | A | * | 5/1984 | Connelly | 36/101 |
| 4,461,102 | A | * | 7/1984 | DeVincentis | 36/101 |
| 4,869,000 | A | * | 9/1989 | York, Jr. | 36/11.5 |
| 5,083,385 | A | | 1/1992 | Halford | |
| 5,778,564 | A | | 7/1998 | Kettner | |
| 5,992,058 | A | | 11/1999 | Jneid | |
| 2002/0124434 | A1 | | 9/2002 | Hsin et al. | |
| 2003/0177665 | A1 | | 9/2003 | Monassebian | |
| 2004/0064976 | A1 | | 4/2004 | Barteet | |

* cited by examiner

*Primary Examiner*—Ted Kavanaugh
(74) *Attorney, Agent, or Firm*—Phillips Lytle LLP

(57) ABSTRACT

The invention is directed to an article of footwear (15). In the preferred embodiment, article of footwear comprises a sole portion (16) having a top surface (24), an opposed bottom surface (25) and a perimeter edge (32) between the top and bottom surfaces, a plurality of loops (21*a–f*) secured to the sole portion, and an upper portion (18) adapted to enwrap a foot (17) and having a plurality of loop attachments (20*a–f*) adapted to detachably engage the loops, wherein the upper portion maybe detachably secured to the sole portion and a foot. The sole portion may comprise an upper layer (28–30) and a lower layer (31) and the loops may be secured to the sole portion between the upper layer and the lower layer. The loop attachments may be hooks (20, 44), clasps (42), ties (43) or clips (45). The footwear may further comprise a second upper portion (36) adapted to enwrap the foot and having a plurality of loop attachments (39*a–f*) adapted to detachably engage the loops of the sole portion, wherein the second upper portion is interchangeable with the first upper portion.

7 Claims, 7 Drawing Sheets

INTERCHANGEABLE FOOTWEAR SYSTEM

TECHNICAL FIELD

The present invention relates to the field of footwear and, more particularly, to footwear which allows for the attachment of a variety of easily detachable and interchangeable upper enwrapping elements with the same sole.

BACKGROUND ART

Detachable shoe systems are known in the prior art. For example, U.S. Pat. No. 5,992,058 discloses a system in which different straps may be attached to a shoe sole with a plurality of snaps and Velcro®.

However, systems known in the prior art are cumbersome, awkward, indiscrete and do not provide for the easy interchanging of the upper portion of the shoe with the sole. Hence, it would be beneficial to provide multiple interchangeable upper portions that may be easily detached from and interchanged with a single sole without detracting from the aesthetics and functionality of the shoe.

DISCLOSURE OF THE INVENTION

With parenthetical reference to the corresponding parts, portions or surfaces of the disclosed embodiment, merely for the purposes of illustration and not by way of limitation, the present invention provides an improved article of footwear (15) comprising a sole portion (16) having a top surface (24), an opposed bottom surface (25) and a perimeter outside edge (32) between the top and bottom surfaces, a plurality of loops (21*a–f*) secured to the sole portion, and an upper portion (18) adapted to enwrap a foot (17) and having a plurality of loop attachments (20*a–f*) adapted to detachably engage the loops, wherein the upper portion may be detachably secured to the sole portion and a foot. The sole portion may comprise an upper layer (28–30) and a lower layer (31) and the loops may be secured to the sole portion between the upper layer and the lower layer. The upper layer may comprise a top layer (28), a cushioning layer (29) and an inner layer (30). The upper portion may comprise a plurality of straps (23). The loop attachments may be hooks (20, 44), clasps (42), ties (43) or clips (45). The loops may be spaced incrementally about the perimeter edge and the sole may have at least six loops. The perimeter edge may have a left side (33) and an opposed right side (34) and three of the loops (21*a–c*) may positioned on the left side and three of the loops (21*d–f*) may positioned on the right side. The footwear may further comprise a second upper portion (36) adapted to enwrap the foot and having a plurality of loop attachments (39*a–f*) adapted to detachably engage the loops of the sole portion, wherein the second upper portion is interchangeable with the first upper portion.

Accordingly, the general object of the present invention is to provide an article of footwear that allows for the upper portion of the shoe to be detached and interchanged with alternate upper portions, each having a different design or configuration.

Another object is to provide an article of footwear which permits the wearer to achieve a different looking shoe or sandal with the same sole.

Another object is to provide an article of footwear in which different configurations of straps may be used to fasten the sole to the user's foot.

Another object is to provide an article of footwear having a single sole with a variety of interchangeable upper portions.

Another object is to provide an article of footwear in which the sole has easily detachable fasteners that allow for alternate upper portions to be detachably fastened to the sole and interchanged depending on the desires of the wearer.

Another object is to provide an article of footwear that permits the wearer to actively participate in the design or look of the footwear.

Another object is to provide an article of footwear that has detachable fasteners that are partially obscured from view when the footwear is worn.

Another object is to provide an article of footwear that permits the creation of multiple shoes using the same sole.

These and other objects and advantages will become apparent from the foregoing and ongoing written specification, the drawings, and the appended claims.

DESCRIPTION OF THE PREFERRED EMBODIMENTS

Figure 1:
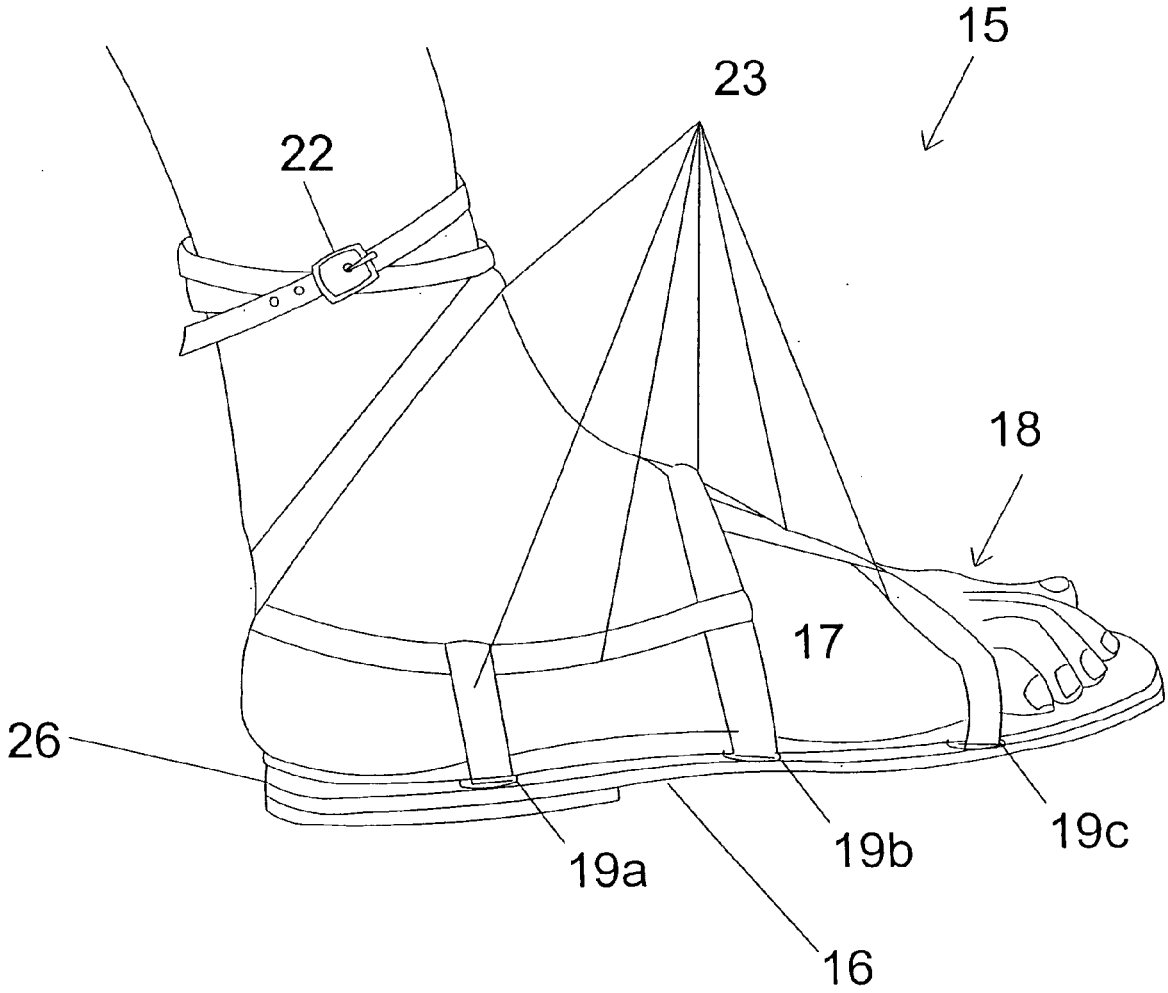
FIG. 1 is a perspective view of the article of footwear on a foot.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, this invention provides an improved article of footwear, of which the presently preferred embodiment is generally indicated at 15. Article 15 is shown as broadly including an upper portion 18 and a sole portion 16. Upper portion 18 is detachably connected to sole portion 16 with fasteners 19*a–f*. In the preferred embodiment, fasteners 19*a–i f* are comprised of hooks 20*a–f* and loops 21*a–f*.

As shown in FIG. 1, upper portion 18 comprises multiple straps 23 configured and arranged to enwrap the foot 17 of the person wearing article 15. As shown, straps 23 extend over the top of foot 17 and around the heel of foot 17, with the two ends of straps 23 connecting at the ankle of foot 17 with buckle 22, thereby enwrapping foot 17 and securing sole 16 to the bottom of foot 17. Hooks 20*a–f* are attached to straps 23 at six key points. Hooks 20*a–f* are positioned on straps 23 so as to hold sole 16 tightly in place when upper portion 18 enwraps foot 17 and fasteners 19*a—f* are attached. In the preferred embodiment, three hooks 20*a–c* are positioned to attach to loops 21*a–c* of sole 16 to the right of foot 17 and three hooks 20*d–f* are positioned to attach to loops 21*d–f* on the left side of foot 17.

Figure 2:
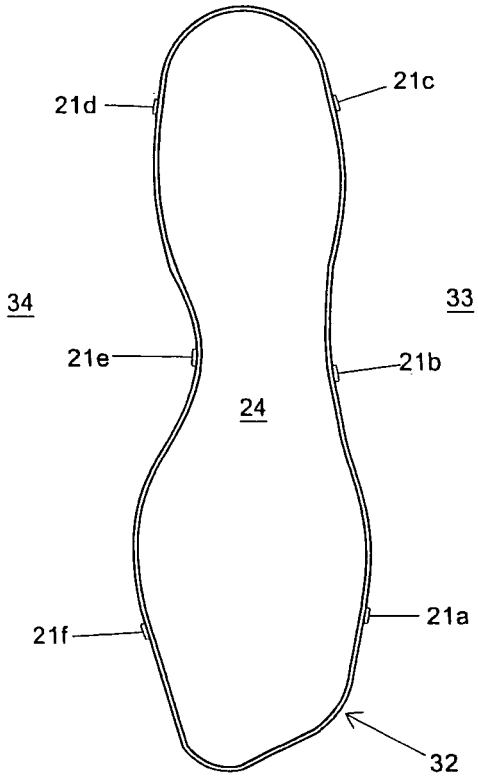
FIG. 2 is a top plan view of the sole portion shown in FIG. 1.
Figure 3:
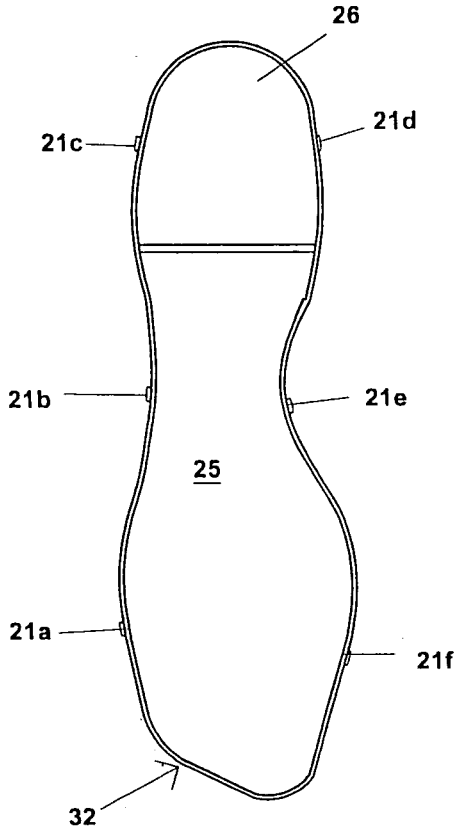
FIG. 3 is a bottom plan view of the sole portion shown in FIG. 1.
Figure 4:
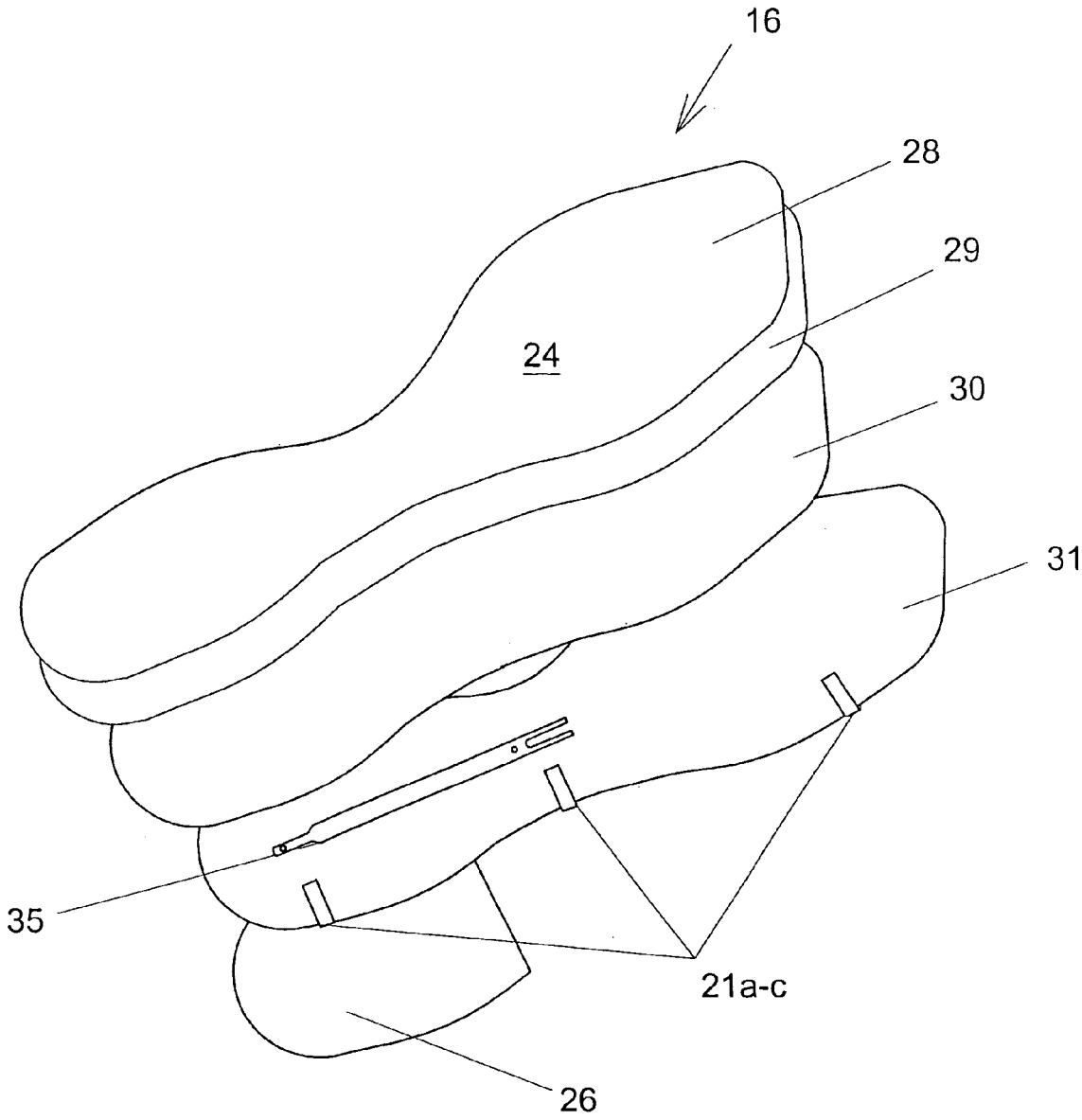
FIG. 4 is an exploded view of the sole portion shown in FIG. 1.

As shown in FIGS. 2–4, sole 16 has a top surface 24, a bottom surface 25, an outer perimeter edge 32, and a conventional heel 26 fixed to bottom surface 25. Sole 16 is formed with four laminated layers and has a top leather layer 28, an orthopedic cushioning layer 29, a leather inner sole layer 30 and a leather outer sole layer 31. Layers 28-31 are laminated together with adhesive or mechanical fasteners to provide a thin cushioned sole with an outer perimeter edge 32, which generally has the some shape as a person's foot. Sole 16 can be produced in different sizes so as to fit different sized feet.

Figure 5:
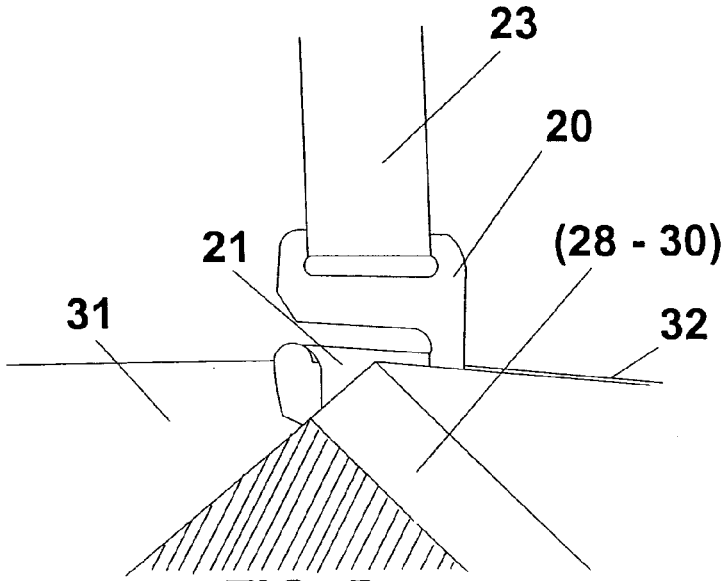
FIG. 5 is an enlarged view of the fastener shown in FIG. 1.
Figure 6:
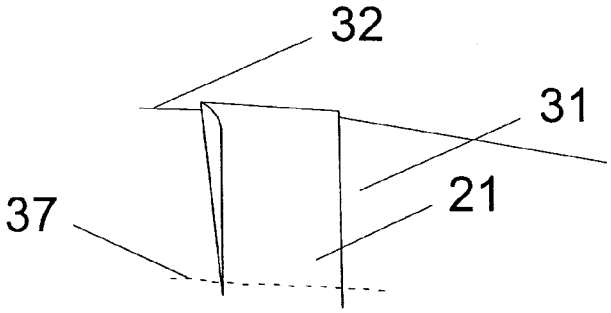
FIG. 6 is a partial view of the loop shown in FIG. 5.
Figure 7:
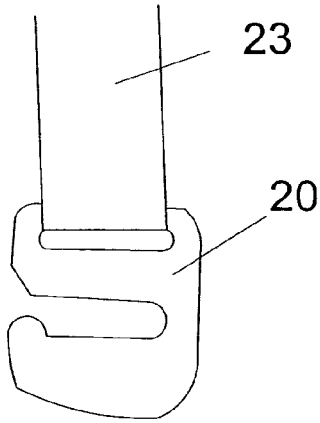
FIG. 7 is partial view of the loop attachment shown in FIG. 5.

As shown in FIG. 4, six loops 21*a–f* are attached to sole 16 between inner sole layer 30 and outer sole layer 31. Loops 21*a–f* are attached to sole 16 at six key points of support. As shown in FIGS. 5 and 6, loops 21*a–f* are formed from narrow strips of leather that are folded in the middle. The two ends of each strip are secured between layers 30 and 31 with adhesive and/or stitching 37 and are positioned so that the folded end extends slightly from perimeter edge 32 to form a loop. As shown, loops 21*a–f* are not readily visible and are partially obscured between layers 30 and 31.

In the preferred embodiment, six loops 21 *a–f* are provided, with three loops 21*a–c* provided on the right side 34 of sole 16 and three loops 21*d–f* on the left side 33 of sole 16. Loops 21*a–f* are spaced incrementally around the perimeter edge 32 of sole 16. It is contemplated that the number and positioning of loops 21 may be varied as may the material used to form the loops and the mechanism for attaching them to sole 16. For example, the loops may be elastic or denim.

Heel 26 is attached to the rear bottom surface 25 of sole 16. It is contemplated that the shape, height and material of the heel maybe varied as desired. As shown in FIG. 4, a conventional shank 35 is also interposed between layers 30 and 31.

Figure 8:
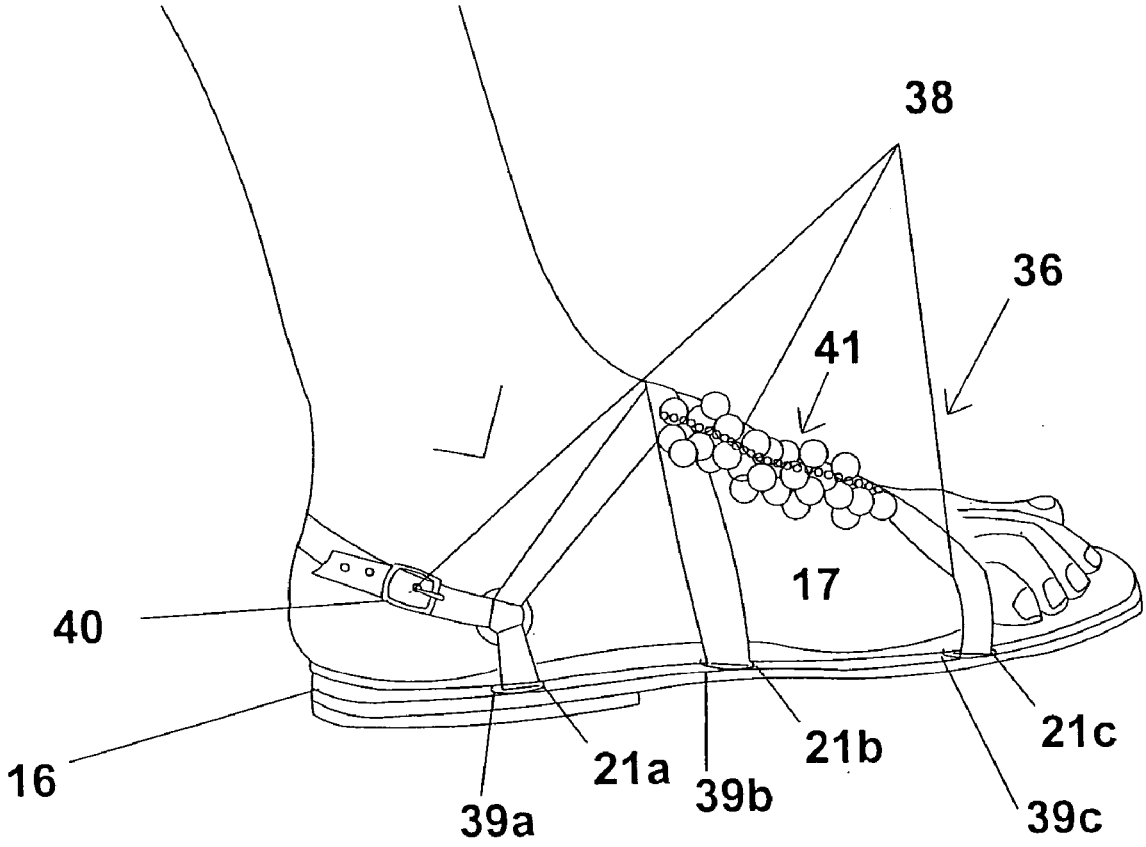
FIG. 8 is a perspective view of the sole portion shown in FIG. 1 with an alternate upper portion.

FIG. 8 shows the interchangeable nature of footwear 15. In FIG. 8, an alternate enwrapping upper portion 36 has been interchanged with the upper portion 18 shown in FIG. 1. As indicated, upper portion 18 may be interchanged with portion 36 by disengaging hooks 20*a–f* from loops 21*a–f*, removing upper portion 18 from foot 17, replacing upper portion 18 with upper portion 36 by inserting hooks 39*a–f* of upper portion 36 into loops 21*a–f*, respectively, and by enwrapping foot 17 with upper portion 36. Thus, fasteners 19*a–f* are employed to secure the upper portion 18 of footwear 15 to sole portion 16 in an easily detachable manner. As shown in FIG. 8, upper portion 36 provides a different look and enwraps foot 17 differently than upper portion 18. Straps 38 wrap over the top of foot 17 and attach near the heel of foot 17 at buckle 40, and include an ornamental element 41 on top of foot 17. While only two examples of upper portions have been described, multiple variations of uppers may be used with the same sole portion.

Figure 9:
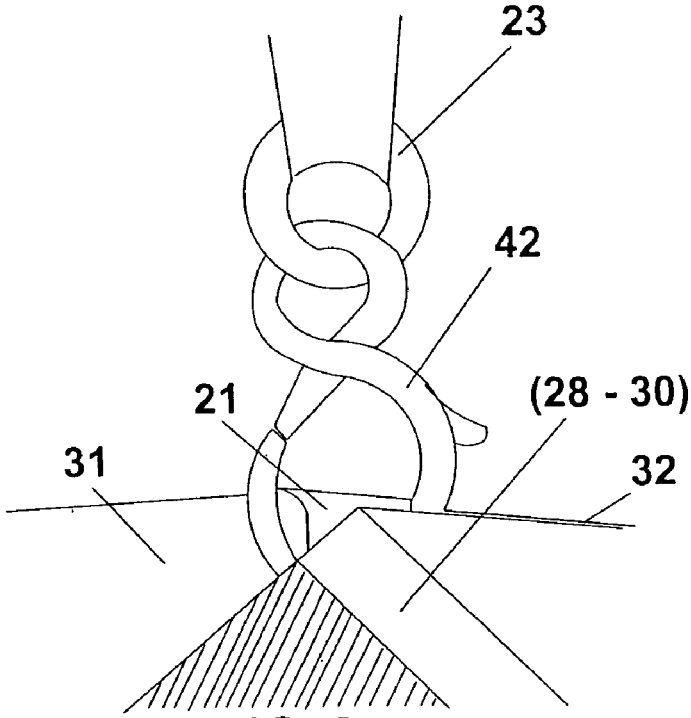
FIG. 9 is a partial view of an alternate embodiment of the fastener shown in FIG. 5.
Figure 10:
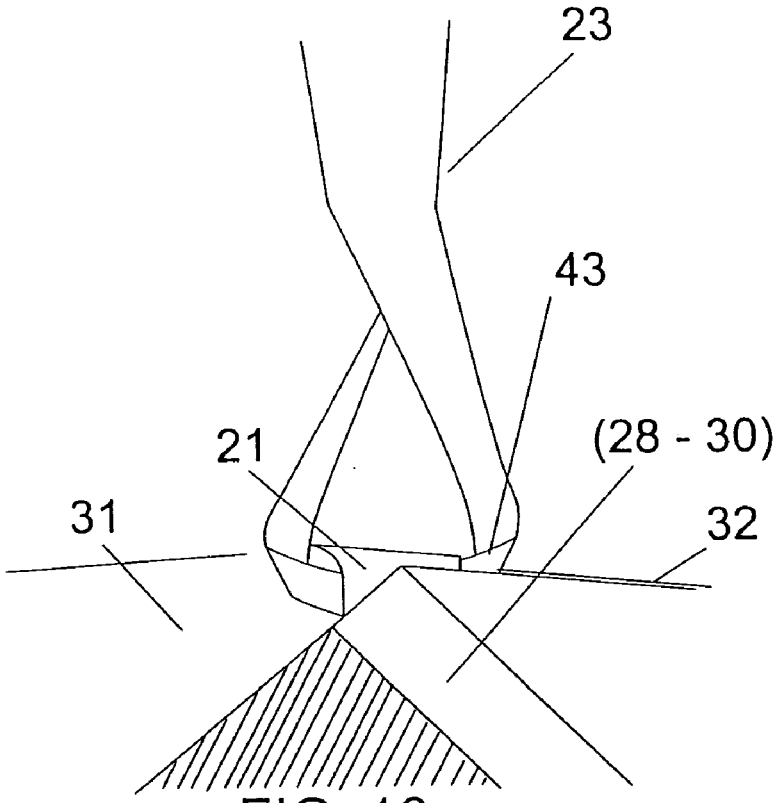
FIG. 10 is a partial view of a second alternate embodiment of the fastener shown in FIG. 5.
Figure 11:
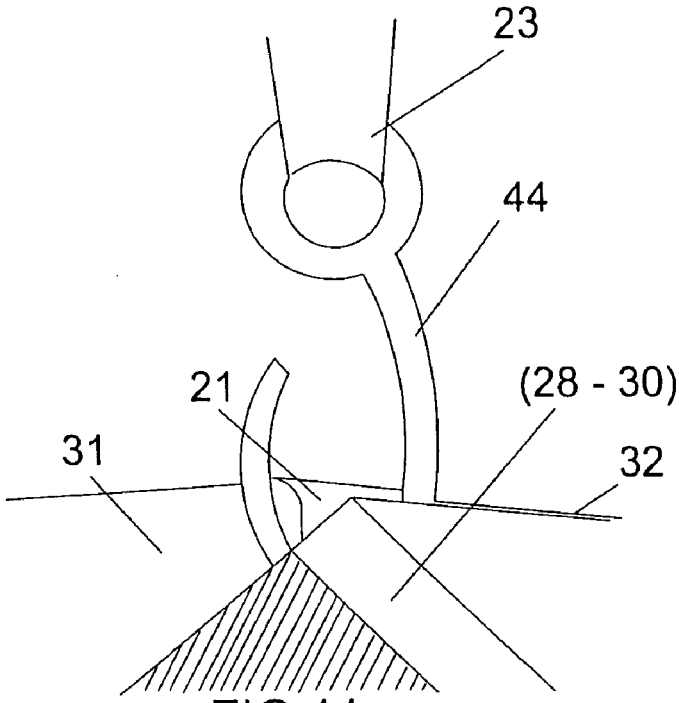
FIG. 11 is a partial view of a third alternate embodiment of the fastener shown in FIG. 5.
Figure 12:
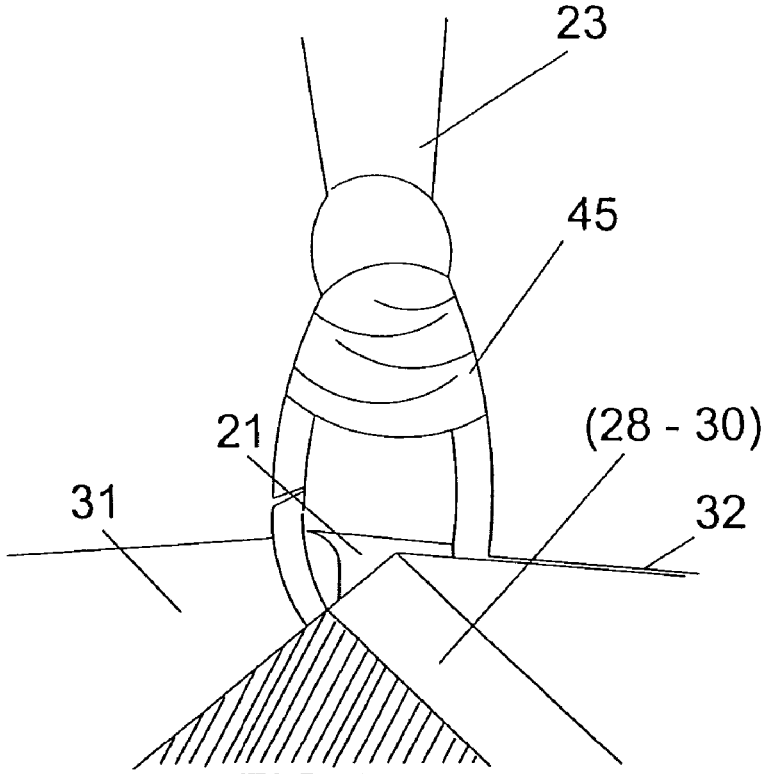
FIG. 12 is a partial view of a fourth alternate embodiment of the fastener shown in FIG. 5.

As described above, in the preferred embodiment hooks 20*a–f* are used as the attachment to loops 21*a–f*. However, other loop attachments may be employed. For example, as shown in FIG. 9, hooks 20*a–f* may be replaced with conventional clasps 42. As shown in FIG. 9, clasps 42 allow for straps 23 to detachably engage loops 21. It is contemplated that multiple different types of clasps, such as spring ring clasps, bar toggle clasps and lobster claw clasps, may be employed. Alternatively, as shown in FIG. 10, a conventional tie ribbon 43 may be used to detachably engage loop 21. FIG. 11 shows yet another embodiment in which a differently-configured hook 44 is used to detachably connect straps 23 to loops 21. FIG. 12 shows a fourth embodiment in which a conventional clip 45 is employed to detachably engage loop 21. It is contemplated that a number of different types of clips, such as a flag clip, may be employed. While a number of types of loop attachments have been described, other types may also be used.

The present invention contemplates that many changes and modifications may be made. Therefore, while the presently-preferred form of the improved article of footwear has been shown and described, and several modifications thereof discussed, persons skilled in this art will readily appreciate that various additional changes and modifications may be made without departing from the spirit of the invention, as defined and differentiated by the following claims.

What is claimed is:

1. An article of footwear comprising:

a sole portion having an upper surface, an opposed bottom surface, a perimeter outside edge between said upper and bottom surfaces, an upper layer and a lower layer;

a plurality of loops, each of said loops consisting of being formed from a strip of folded material and secured directly to said sole portion between said upper layer and said lower layer; and an upper portion adapted to enwrap a foot and having a plurality of connected straps, each of said straps having a hook, clasp or clip adapted to directly and detachably engage one of said loops.

2. The footwear of claim 1, wherein said upper layer comprises a top layer, a cushioning layer and an inner layer.

3. The article of footwear of claim 1, wherein said loops are spaced incrementally about said perimeter edge.

4. The article of footwear of claim 3, wherein said sole has at least six of said loops.

5. The article of footwear of claim 4, wherein said perimeter edge has a left side and an opposed right side and three of said loops are positioned on said left side and three of said loops are positioned on said right side.

6. The article of footwear of claim 1, and further comprising a second upper portion adapted to enwrap said foot and having a plurality of loop attachments adapted to detachably engage said loops of said sole portion, wherein said second upper portion is interchangeable with said upper portion.

7. The article of footwear of claim 1, wherein said loop material is leather.

* * * * *